US005597424A

United States Patent [19]

Yoshitomi et al.

[11] Patent Number: 5,597,424

[45] Date of Patent: Jan. 28, 1997

[54] PROCESS FOR PRODUCING GRAIN ORIENTED ELECTRICAL STEEL SHEET HAVING EXCELLENT MAGNETIC PROPERTIES

[75] Inventors: Yasunari Yoshitomi; Takehide Senuma, both of Kitakyushu, Japan

[73] Assignee: Nippon Steel Corporation, Tokyo, Japan

[21] Appl. No.: 502,238

[22] Filed: Jul. 13, 1995

Related U.S. Application Data

[63] Continuation of Ser. No. 132,146, Oct. 5, 1993, abandoned, which is a continuation of Ser. No. 778,225, filed as PCT/JP91/00493, Apr. 15, 1991, abandoned.

[30] Foreign Application Priority Data

Apr. 13, 1990 [JP] Japan ..... 2-98267

[51] Int. Cl.$^6$ ..... C21D 8/12; C22C 38/60

[52] U.S. Cl. ..... 148/111; 148/112

[58] Field of Search ..... 148/111, 112, 148/113

[56] References Cited

FOREIGN PATENT DOCUMENTS

| | | |
|---|---|---|
| 0326912 | 8/1989 | European Pat. Off. . |
| 2202943 | 5/1974 | France . |
| 40-15644 | 7/1965 | Japan . |
| 46-23820 | 7/1971 | Japan . |
| 51-13469 | 4/1976 | Japan . |
| 52-24116 | 2/1977 | Japan . |
| 54-24685 | 8/1979 | Japan . |
| 57-89433 | 6/1982 | Japan . |
| 57-15832 | 9/1982 | Japan . |
| 59-50118 | 3/1984 | Japan . |
| 59-56522 | 4/1984 | Japan . |
| 59-190324 | 10/1984 | Japan . |
| 59-45730 | 11/1984 | Japan . |
| 1-19622 | 5/1989 | Japan . |
| 1-119621 | 5/1989 | Japan . |
| 1-11962 | 5/1989 | Japan . |
| 1-119622 | 5/1989 | Japan . |
| 2-22421 | 1/1990 | Japan . |
| 2-77525 | 3/1990 | Japan . |

*Primary Examiner*—Sikyin Ip
*Attorney, Agent, or Firm*—Kenyon & Kenyon

[57] ABSTRACT

The present invention relates to the provision of a process for producing a grain oriented electrical steel sheet having excellent magnetic properties, and comprises heating a slab comprising by weight 0.021 to 0.075% of C, 2.5 to 4.5% of Si, 0.010 to 0.060% of acid sol. Al, 0.0030 to 0.0130% of N, 0.014% or less of (S and 0.405 Se) and 0.05 to 0.8% of Mn with the balance being Fe and unavoidable impurities to a temperature below 1280° C. to hot-roll the slab, subjecting the hot rolled sheet to cold rolling with a draft of 80% or more and subjecting decarburization annealing and then finish annealing, characterized in that, after the hot rolling, the hot strip is taken up at a temperature of 600° C. or below and subjected to nitriding at any stage from after the hot rolling to the completion of the secondary recrystallization in the finish annealing without annealing of the hot rolled sheet.

2 Claims, 1 Drawing Sheet

PROCESS FOR PRODUCING GRAIN ORIENTED ELECTRICAL STEEL SHEET HAVING EXCELLENT MAGNETIC PROPERTIES

This application is a continuation of application Ser. No. 08/132,146, filed on Oct. 5, 1993 now abandoned which is a continuation application Ser. No. 07/778,225, filed as PCT/JP91/00493, Apr. 15, 1991, now abandoned.

TECHNICAL FIELD

The present invention relates to a process for producing a grain oriented electrical steel sheet having excellent magnetic properties for use as an iron core for a transformer or the like.

BACKGROUND ART

A grain oriented electrical steel sheet is used mainly as an iron core material for a transformer and other electrical equipment and is excellent in magnetic properties, such as excitative and iron loss properties. The magnetic flux density, $B_8$, at a magnetic field strength of 800 A/m is usually used as a numeric value for expressing the excitative property. The iron core per kg obtained when the steel sheet is magnetized to 1.7 tesla (T) at a frequency of 50 Hz, i.e., $W_{17/50}$, is used as a numeric value for expressing the iron core property. The magnetic flux density is the maximum governing factor of the iron loss property. In general, the higher the magnetic flux density, the better the iron loss property. In some cases, an increase in the magnetic flux density brings about an increase in the size of the secondary recrystallized grain, so that iron loss becomes poor. In this case, the iron loss property can be improved independently of the grain diameter of the secondary recrystallized grain through the control of a magnetic domain.

The grain oriented electrical steel sheet is produced by developing the so-called "Goss structure" having a <001> axis in the direction of rolling and {110} on the surface of the steel sheet through the occurrence of a secondary recrystallization in the final finish annealing. In order to obtain good magnetic properties, it is necessary to arrange <001>, which is an easily magnetizable axis in the direction of rolling.

Representative examples of the process for producing the above-described monodirectional electro-magnetic steel sheet having a high magnetic flux density include a process disclosed in Japanese Patent Publication No. 15644/1965 by Satoru Taguchi et al. and a process disclosed in Japanese Patent Publication No. 13469/1976 by Takuichi Imanaka et al. In the former, MnS and AlN are used mainly as inhibitors while in the latter, MnS, MnSe, Sb, etc. are used mainly as inhibitors. Therefore, in the current technique, it is inevitable to properly control the size, form and dispersed state of the precipitate that functions as the inhibitor. With respect to MnS, in the current process, MnS is completely dissolved in a solid solution form at the time of heating the slab before hot rolling, and precipitation is conducted at the time of hot rolling. In order to completely dissolve MnS in a solid solution form in an amount necessary for secondary recrystallization, it is necessary to apply a temperature of about 1400° C. This temperature is at least 200° C. above the slab heating temperature of common steel. The slab heating treatment at a high temperature has the following disadvantages.

1) It is necessary to use a high temperature slab heating furnace for exclusive use in directional electrical steel.

2) The energy unit of the heating furnace is high.

3) The amount of molten scale increases, which has a large adverse effect on the operation, such as the necessity of scraping slag.

The above-described problems can be avoided by lowering the slab heating temperature to that used in a common steel. This, however, means that MnS effective as the inhibitor is used in a reduced amount or not used at all, which inevitably renders the secondary recrystallization unstable. For this reason, in order to realize the heating of the slab at a low temperature, it is necessary to strengthen the inhibitor with a precipitate other than MnS to sufficiently inhibit the growth of normal grains during finish annealing. Sulfides and further nitrides, oxides, intergranular precipitation elements, etc. are considered as the above-described inhibitor, and the following are examples of known techniques associated therewith.

Japanese Examined Patent Publication (Kokoku) No. 54-24685 discloses a method wherein the slab heating temperature is made in the range of from 1050 ° C. to 1350° C. through the incorporation of an intergranular segregation element, such as As, Bi, Sn or Sb, in the steel. Japanese Unexamined Patent Publication (Kokai) No. 52-24116 discloses a method wherein the slab heating temperature is made in the range of from 1100 ° C. to 1260° C. through the incorporation of a nitride forming element, such as Zr, Ti, B, Nb, Ta, V, Cr or Mo, in addition to Al in the steel. Japanese Unexamined Patent Publication (Kokai) No. 57-158322 discloses a method wherein the heating of a slab at a low temperature is made possible through the lowering of the Mn content so as to have an Mn/S ratio of 2.5 or less and, at the same time, the secondary recrystallization is stabilized through the addition of Cu. Further, a technique wherein the strengthening of the inhibitor is combined with an improvement in the metallic structure has also been disclosed. Specifically, in Japanese Unexamined Patent Publication (Kokai) No. 57-89433, the heating of the slab at a low temperature of 1100 ° C. to 1250° C. is made possible through a combination of the addition of Mn and an additional element, such as S, Se, Sb, Bi, Pb, Sn or B, with the percentage columnar crystal and the draft in the secondary cold rolling of the slab. Further, Japanese Unexamined Patent Publication (Kokai) No. 59-190324 discloses a method of stabilizing the secondary recrystallization which comprises providing an inhibitor composed mainly of S or Se and Al and B and nitrogen and subjecting the inhibitor to pulse annealing at the time of the primary recrystallization annealing after cold rolling. Thus, a great effort has hitherto been made to enable the slab to be heated at a low temperature in the production of grain oriented electrical steel sheet.

The above-described Japanese Unexamined Patent Publication No. 59-56522 discloses that a slab can be heated at a low temperature when the contents of Mn and S are 0.08 to 0.45 and 0.007% or less, respectively. This method has eliminated the problem of occurrence of a linear secondary crystallization defect of a product attributable to the coarsening of slab grains during heating of the slab at a high temperature.

In the production of a grain oriented electrical steel sheet, annealing of a hot rolled sheet is usually conducted after the hot rolling for the purpose of conducting heterogenization of the structure, precipitation, etc. For example, in the process wherein the inhibitor is composed mainly of AlN, as described in Japanese Examined Patent Publication (Kokoku) No. 23820/1971, the inhibitor is regulated through the precipitation of AlN in the annealing of a hot rolled sheet.

The grain oriented electrical steel sheet is usually produced through main steps such as casting-hot rolling-annealing-cold rolling-decarburization annealing-finish annealing. In this process, a great deal of energy is required, and the production cost is unfavorably higher than that of the common steel manufacturing process, etc.

In recent years, there has been a reconsideration of the above-described manufacturing steps, which consume a large amount of energy, and the simplification and omission of some of the steps and the reduction of energy have been demanded. In order to meet the above-described demand, with respect to a process wherein the inhibitor is mainly composed of AlN, a proposal has been made for the replacement of the precipitation of AlN in the annealing of a hot rolled sheet at a high temperature after the hot rolling (see Japanese Examined Patent Publication (Kokoku) No. 59-45730). In this method, the magnetic properties can be ensured to some extent despite the omission of the annealing of a hot rolled sheet. In the usual method wherein the steel is taken up in a coil form in an amount of 5 to 20 tons, there occurs a difference in the heat history between places within the coil during the step of cooling. This inevitably renders the precipitation of AlN heterogeneous, so that the final magnetic properties varies from place to place in the coil, resulting in the lowering of the yield.

On the other hand, in the process wherein the inhibitor is composed mainly of MnS, MnSe and Sb, a proposal has been made for a method wherein the occurrence of a linear secondary recrystallization defect of a product is inhibited by taking up a steel strip at or below a temperature determined depending upon the cooling rate of a hot rolled steel strip in a period between the separation from a finishing final stand and the taking-up of the steel strip (see Japanese Unexamined Patent Publication (Kokai) No. 59-50118). This method is a technique for inhibiting the occurrence of a linear secondary recrystallization defect attributable to heating of the slab at a high temperature, and the production of a steel sheet by a single cold rolling process wherein the method that omits the annealing of the hot rolled sheet has not been considered.

DISCLOSURE OF INVENTION

Under the above-described circumstances, an object of the present invention is to provide a method of stably producing a grain oriented electrical steel sheet having excellent magnetic properties through a single cold rolling process wherein the annealing of a hot rolled sheet is omitted on the assumption that the heating of the slab is conducted at a low temperature.

In order to attain the above-described object, the present inventors have conducted studies with a focus of attention particularly on the step of taking up the sheet after hot rolling and, as a result, have found that the take-up temperature in a particular range has a great effect on the magnetic flux density and that in order to stabilize the secondary recrystallization by the above-described process, nitriding should be conducted in a period between the hot rolling and the completion of the secondary recrystallization, which has led to the completion of the present invention.

The present invention provides a process for producing a grain oriented electrical steel sheet having excellent magnetic properties, characterized by heating a slab comprising by weight 0.021 to 0.075% of C, 2.5 to 4.5% of Si, 0.010 to 0.060% of acid sol. Al, 0.0030 to 0.0130% of N, 0.014% or less of (S and 0.405 Se) and 0.05 to 0.8% of Mn with the balance being Fe and unavoidable impurities to a temperature below 1280° C. to hot-roll the slab, taking up the resultant hot strip at a temperature of 600° C. or below, subjecting the hot rolled sheet to cold rolling with a draft of 80% or more without annealing the hot rolled sheet and subjecting the cold rolled sheet to decarburization annealing and then finish annealing, said steel sheet being subjected to nitriding in any stage from after the hot rolling to the completion of the secondary recrystallization in the finish annealing.

BEST MODE FOR CARRYING OUT THE INVENTION

Figure 1:
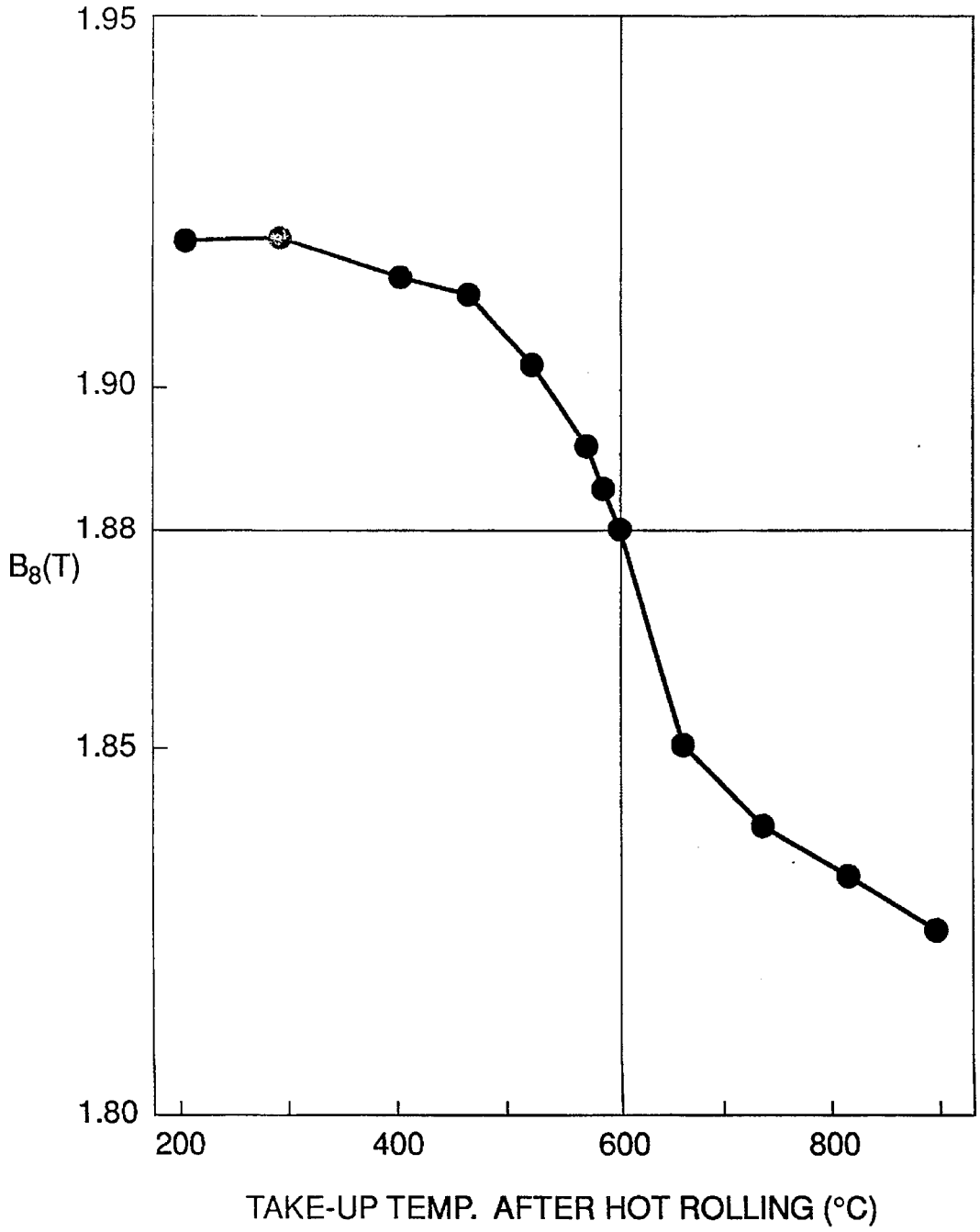
FIG. 1 is a graph showing the relationship between the take-up temperature after hot rolling and the magnetic flux density.

The grain oriented electrical steel sheet intended in the present invention is produced by subjecting a molten steel produced by the conventional steel making process to casting according to a continuous casting process or ingot making process and optionally a step of blooming to prepare a slab, subsequently hot-rolling the slab to form a hot rolled sheet and subjecting the hot rolled sheet to cold rolling with a draft of 80% or more, decarburization annealing and final finish annealing in that order without annealing the hot rolled sheet.

The present invention is premised on the heating of a slab at a low temperature, omission of annealing of a hot rolled sheet and single cold rolling.

Based on the following experimental results, the present inventors have found the above-described novel fact that the take-up temperature is closely related to the magnetic properties.

The present invention will now be described in more detail with reference to the following experimental results.

FIG. 1 is a graph showing the relationship between the take-up temperature after hot rolling and the magnetic flux density. In this case, a 40 mm-thick slab as a starting material comprising 0.052% by weight of C, 3.25% by weight of Si, 0.027% by weight of acid sol. Al, 0.0078% by weight of N, 0.007% by weight of S and 0.14% by weight of Mn with the balance being Fe and unavoidable impurities were heated to 1150° C. subjected to hot rolling through 6 passes to reduce the thickness to 2.3 mm, cooled to 200 ° C. to 900° C. through various combinations of water cooling with air cooling, maintained at each temperature (take-up temperature) for 1 hr, and then subjected to furnace cooling (cooling rate: about 0.01° C./sec) to conduct a take-up simulation. Then, the hot rolled sheet was rolled with a high draft of about 85% without annealing, and the cold rolled sheet was maintained at 840° C. for 150 sec for decarburization annealing. Subsequently, nitriding was conducted by introducing $NH_3$ gas in an annealing atmosphere during annealing wherein the sheet was maintained at 750° C. for 30 sec. The N content of the steel sheet after nitriding was 0.0188 to 0.0212% by weight. The steel sheet was then coated with an annealing separating agent composed mainly of MgO and then subjected to final finish annealing.

As is apparent from FIG. 1, when the take-up temperature after hot rolling is 600° C. or below, the magnetic density, $B_8$, is as high as 1.88 T.

Although the reason why the magnetic flux density can be improved when the take-up temperature is 600° C. or below has not been fully explained, the inference of the present inventors is as follows.

In cooling after taking up the hot rolled sheet, since the steel sheet is usually air-cooled in a coil form in an amount of 5 to 20 tons, the cooling rate is very low, for example, 0.005° C./sec. During cooling after the take-up operation, $Fe_3C$, $Fe_{16}N_4$, etc., precipitate in a grain boundary, around a grain boundary or around a transgranular precipitate (for example, MnS, AlN or the like) as a nucleus. When the size of $Fe_3C$ or the like is relatively small (for example, 1 μm or less), there is a possibility that part of the $Fe_3C$ dissociates and dissolves in a solid solution form during cold rolling and C and N in a solid solution form are newly formed during cold rolling. The reason why the effect of the present invention cannot be attained at a high take-up temperature above 600° C. is believed to reside in that dissociation and formation of a solid solution during cold rolling is insufficient due to high susceptibility of $Fe_3C$ coarsening during cooling after the take-up operation at a high temperature, insufficient precipitation of $Fe_{16}N_4$ attributable to an increase in the precipitation of AlN, $Si_3N_4$ or the like, or high susceptibility of $Fe_{16}N_4$ coarsening during cooling even when the $Fe_{16}N_4$ successfully precipitates. The effect of the present invention can be attained through the following mechanism. Part of a relatively small amount of $Fe_3C$, $Fe_{16}N_4$ , etc. formed during cooling after taking up the hot rolled sheet dissociates and dissolves in a solid solution form, C and N in a solid solution form are newly formed and attach to defects, such as dislocation, formed during cold rolling, and this has an effect on the deformation mechanism. This effect facilitates the formation of a deformation zone during cold rolling and increases the number of grains having {110} <001> orientation during recrystallization in cold rolling, thereby improving the magnetic properties.

In the present invention, the reason why nitriding should be conducted at any stage from after the hot rolling to the completion of the secondary recrystallization in the finish annealing is that in the present invention, premised on the heating of a slab at a low temperature and the omission of annealing of a hot rolled sheet, the nitriding in the above-described stage is necessary for stabilizing the secondary recrystallization.

In the step of nitriding in the present invention, it is especially preferred to reduce the N content of the slab and increase the N content by a predetermined value, for example, 0.0001% by weight or more, at a suitable stage after the above-described hot rolling.

In the steel sheet of the present invention, the above-described step can stabilize the secondary recrystallization to a great extent, which enables a high magnetic flux density to be obtained.

The reason for the limitation of the constituent features of the present invention will now be described.

At the outset, the reason for the limitation of the components of the slab will be described.

The C content is limited to 0.021% by weight (hereinafter referred to simply as "%") or more because when it is less than 0.021% by weight, the secondary recrystallization become unstable and it is difficult to obtain a $B_8$ value exceeding 1.80 (T) even in the case of successful secondary recrystallization. Further, the C content should be 0.075% because when the C content is excessively high, the profitability lowers due to the necessity of the prolonged decarburization annealing time.

The Si content is limited to 4.5% or less because when it exceeds 4.5%, cracking becomes significant during cold rolling. Further, the Si content should be 2.5% or more because when it is less than 2.5%, the resistivity of the material is so low that no low iron loss, necessary as an iron core material for a transformer, can be obtained. The Si content is desirably 3.2% or more.

The content of Al and N should be 0.010% or more in terms of acid sol. Al for ensuring AlN or (Al, Si) nitrides necessary for the stabilization of secondary recrystallization. When the acid sol. Al content exceeds 0.060%, the AlN content becomes improper, so that the secondary recrystallization becomes unstable. Accordingly, the acid sol. Al content should be 0.060 or less.

With respect to N, in the conventional steel making operation, since it is difficult to reduce the N content to less than 0.0030%, the reduction of the N content to less than 0.0030% is unfavorable from the viewpoint of profitability. For this reason, the N content should be 0.0030%. When the N content exceeds 0.0130%, there occurs "bulging on the surface of the steel sheet" called "blistering". For this reason, the N content should be 0.0130% or less.

Even when MnS and MnSe are present in the steel, it is possible to improve the magnetic properties through proper selection of the conditions of the manufacturing steps. When the S and Se contents are high, there is a tendency for a secondary recrystallization defect called a banded fine grain to occur. In order to prevent the occurrence of the secondary recrystallization defect, it is desired for the content of (S +0.405 Se) to be 0.014% or less. When the S or Se content exceeds the above-described value, the probability of occurrence of the secondary recrystallization defect unfavorably becomes high regardless of how the manufacturing conditions vary. Further, in this case, the time necessary for purification in the final finish annealing unfavorably becomes too long. For this reason, an unnecessary increase in the S or Se content makes no sense.

The lower limit of the Mn content is 0.05%. When the Mn content is less than 0.05%, the form (flatness) of a hot rolled sheet prepared by hot rolling, especially the side end of the strip, becomes wavy, so that the yield of the product is unfavorably lowered. Further, the Mn content should be 0.8% or less because when the Mn content exceeds 0.8%, the magnetic flux density of the product becomes low.

The reason for the limitation of the manufacturing steps will now be described.

The slab heating temperature is limited to below 1280° C. for the purpose of reducing the cost to one comparable with that of the common steel. It is preferably 1200° C. or below.

The heated slab is subsequently hot-rolled to form a hot rolled sheet.

The step of hot rolling generally comprises rough rolling and finish rolling, both of which are conducted through a plurality of passes after the heating of a slab having a thickness of 100 to 400 mm. There is no particular limitation on the rough rolling method, and the rough rolling may be conducted by the conventional method. The finish rolling is conducted through continuous rolling at a high speed usually in 4 to 10 passes. The rolling rate is usually 100 to 3000 m/min, and the pass-to-pass time is 0.01 to 100 sec. After the completion of the hot rolling, the temperature of the steel sheet is lowered by air cooling followed by water cooling, and the steel sheet is then taken up in a coil form in an amount of 5 to 20 tons. The characteristic feature of the present invention resides in the step of taking up the steel sheet.

As described above, the take-up temperature after hot rolling is regulated to 600° C. or below for the purpose of preparing a product having a good magnetic flux density, $B_8$, of 1.88 (T) or more (see FIG. 1). The lower limit of the take-up temperature is not particularly limited. However, in order to take up the steel sheet at room temperature (for example, 20° C.) or below, it is necessary to use a special cooling system, such as water cooling or mist cooling, other than the ordinary cooling system, which renders this method unfavorable from the viewpoint of industry. Since the steel sheet after taking-up is air-cooled in a coil form in an amount of 5 to 20 tons, the cooling rate is as low as about 0.005° C./sec. There is no particular limitation on the cooling. When the take-up temperature is about 450 ° C. to 600° C., however, it is preferable to use a means of enhancing the cooling rate, such as water cooling, for the purpose of inhibiting an excessive increase in the formation of a precipitate, such as $Fe_3C$.

Then, the hot rolled sheet is cold-rolled without subjecting it to annealing. In the step of cold rolling, the draft is limited to 80% or more for the reason that when the draft is in the above-described range, it is possible to obtain proper amounts of a sharp {110} <001> oriented grain and a corresponding oriented grain (such as {111} <112> oriented grain) susceptible to pitting by {110} <001> oriented grain in a decarburized sheet, which contributes to an enhancement in the magnetic flux density.

After cold rolling, the steel sheet is subjected to decarburization annealing, coating with an annealing separating agent and finish annealing to obtain a final product.

Further, as described above, in the present invention, nitriding is conducted at any stage from after the hot rolling to the completion of the secondary recrystallization in the final finish annealing. In this case, there is no particular limitation on the step, method, etc. for conducting the nitriding. The nitriding may be conducted by any method wherein the steel sheet is subjected to nitriding in a strip form at the time of the decarburization annealing or after the decarburization annealing through the use of $NH_3$ gas, a method wherein the nitriding is conducted through the use of plasma, a method wherein a nitride, such as MnN, MoN or CrN, is incorporated in the annealing separating agent and the nitride is decomposed at the time of the final finish annealing to nitride the steel sheet, and a method wherein the nitriding is conducted by enhancing the partial pressure of the atmosphere gas in the final finish annealing.

EXAMPLES

The present invention will now be described with reference to the following examples.

Example 1

A 40 mm-thick slab comprising 0.053% by weight of C, 3.24% by weight of Si, 0.14% by weight of Mn, 0.006% by weight of S, 0.028% by weight of acid sol. Al and 0.0079% by weight of N with the balance being Fe and unavoidable impurities were heated at 1150° C., and hot rolling was initiated at 1040° C. and subjected to 6 passes to form a hot rolled sheet having a thickness of 2.3 mm. In this case, the temperature at completion of the hot rolling was 905° C. After the hot rolled sheet was air-cooled for 1 sec, it was cooled at a cooling rate of 100° C./sec to (1) 700° C., (2) 500° C. and (3) 300° C. maintained at each temperature (take-up temperature) for 1 hr and then subjected to furnace cooling (cooling rate: about 0.01° C./sec) to conduct a take-up simulation. Then, the hot rolled sheet was rolled with a draft of about 85% without annealing to form a cold rolled sheet having a thickness of 0.335 mm.

Thereafter, the cold rolled sheet was subjected to decarburization annealing at 830° C. for 150 sec (soaking) and then annealing at 750° C. for 30 sec (soaking) during which $NH_3$ gas was introduced in the atmosphere. The N content of the steel sheet after the annealing was 0.0195 to 0.0211% by weight. The steel sheet after the nitriding was coated with an annealing separating agent composed mainly of MgO. The temperature of the coated steel sheet was raised at a rate of 15° C./hr to 1200° C. in an atmosphere gas consisting of 25% of $N_2$ and 75% of $H_2$, and the steel sheet was subsequently maintained at 1200° C. for 20 hr in an atmosphere gas consisting of 100% of $H_2$ to conduct a final finish annealing.

The process condition and the magnetic property of the product are given in Table 1.

TABLE 1

| Take-up condition after hot rolling | $B_8$ (T) | Remarks |
|---|---|---|
| 1 | 1.85 | Comp. Ex. |
| 2 | 1.89 | Present invention |
| 3 | 1.91 | Present invention |

Example 2

A 26 mm-thick slab comprising 0.043% by weight of C, 3.25% by weight of Si, 0.16% by weight of Mn, 0,006% by weight of S, 0.029% by weight of acid sol. Al and 0.0081% by weight of N with the balance being Fe and unavoidable impurities were heated at 1150° C., and hot rolling was initiated at 1056° C. and subjected to 6 passes to form a hot rolled sheet having a thickness of 2.0 mm. In this case, the temperature at completion of the hot rolling was 925° C. After the hot rolled sheet was air-cooled for 1 sec, it was cooled at a cooling rate of 66° C./sec to (1) 750° C. and (2) 450° C., maintained at each temperature (take-up temperature) for 1 hr and then subjected to furnace cooling to conduct a take-up simulation. Then, the hot rolled sheet was rolled with a draft of about 86% without annealing to form a cold rolled sheet having a thickness of 0.285 mm.

Thereafter, the cold rolled sheet was maintained at 830° C. for 120 sec and then at 850° C. for 20 sec, thereby conducting decarburization annealing, and then subjected to two treatments, that is, (a) annealed at 700° C. for 30 sec (soaking) during which $NH_3$ gas was introduced in the atmosphere gas, thereby nitriding the steel sheet (N content after nitriding: 0.0215 to 0.0240% by weight) and (b) no nitriding treatment. Then, the steel sheet was coated with an annealing separating agent composed mainly of MgO. The temperature of the coated steel sheet was raised at a rate of 15° C./hr to 1200° C. in an atmosphere gas consisting of 15% of $N_2$ and 85% of $H_2$, and the steel sheet was subsequently maintained at 1200° C. for 20 hrs in an atmosphere gas consisting of 100% of $H_2$ to conduct a final finish annealing.

The process condition and the magnetic property of the product are given in Table 2.

TABLE 2

| Take-up condition after hot rolling | Nitriding condition | $B_8$ (T) | Remarks |
|---|---|---|---|
| 1 | a | 1.83 | Comp. Ex. |
| 1 | b | 1.65 | Comp. Ex. |
| 2 | a | 1.90 | Present invention |
| 2 | b | 1.68 | Comp. Ex. |

Example 3

A 60 mm-thick slab comprising 0.036% by weight of C, 3.26% by weight of Si, 0.15% by weight of Mn, 0.007% by weight of S, 0.029% by weight of acid sol. Al and 0.0078% by weight of N with the balance being Fe and unavoidable impurities were heated at 1150° C., and hot rolling was initiated at 1100° C. and subjected to 6 passes to form a hot rolled sheet having a thickness of 3.4 mm. In this case, the temperature at completion of the hot rolling was 1035° C. After the hot rolled sheet was air-cooled for 1 sec, it was cooled at a cooling rate of 58° C./sec to (1) 650° C. and (2) 300° C., maintained at each temperature (take-up temperature) for 1 hr and then cooled by two methods, that is, (a) furnace cooling (cooling rate: 0.01° C./sec) and (b) water cooling (cooling rate: 30° C./sec). Then, the hot rolled sheet was rolled with a draft of about 85% without annealing to form a cold rolled sheet having a thickness of 0.50 mm. Thereafter, the cold rolled sheet was maintained at 830° C. for 200 sec and then annealed at 750° C. for 30 sec (soaking) during which $NH_3$ gas was introduced in the atmosphere gas, thereby nitriding the steel sheet. The N content after nitriding was 0.0185 to 0.0215% by weight. The steel sheet after the nitriding was coated with an annealing separating agent composed mainly of MgO. The temperature of the coated steel sheet was raised at a rate of 20° C./hr to 1200° C. in an atmosphere gas consisting of 25% of $N_2$ and 75% of $H_2$, and the steel sheet was subsequently maintained at 1200° C. for 20 hr in an atmosphere gas consisting of 100% of $H_2$ to conduct a final finish annealing.

The process condition and the magnetic property of the product are given in Table 3.

TABLE 3

| Take-up temp. condition | Cooling condition after taking-up | $B_8$ (T) | Remarks |
|---|---|---|---|
| 1 | a | 1.84 | Comp. Ex. |
| 1 | b | 1.87 | Comp. Ex. |
| 2 | a | 1.90 | Present invention |
| 2 | b | 1.92 | Present invention |

Example 4

A 40 mm-thick slab comprising 0.049% by weight of C, 3.25% by weight of Si, 0.16% by weight of Mn, 0.007% by weight of S, 0.029% by weight of acid sol. Al and 0.0082% by weight of N with the balance being Fe and unavoidable impurities were heated at 1200° C., and hot rolling was initiated at 1160° C. and subjected to 6 passes to form a hot rolled sheet having a thickness of 2.3 mm. In this case, the temperature at completion of the hot rolling was 983° C. After the hot rolled sheet was air-cooled for 1 sec, it was cooled at a cooling rate of 100° C./sec to (1) 700° C. and (2) 450° C., maintained at each temperature (take-up temperature) for 1 hr and then subjected to furnace cooling to conduct a take-up simulation. Then, the hot rolled sheet was rolled with a draft of about 85% without annealing to form a cold rolled sheet having a thickness of 0.335 mm. Thereafter, the cold rolled sheet was maintained at 830° C. for 120 sec and subsequently maintained at 890° C. for 20 sec to conduct decarburization annealing. Thereafter, the steel sheet was coated with an annealing separating agent composed mainly of MgO. The temperature of the coated steel sheet was raised at a rate of 10° C./hr to 880° C. in an atmosphere gas consisting of 25% of $N_2$ and 75% of $H_2$ and raised at a rate of 10° C./hr to 1200° C. in an atmosphere gas consisting of 25% of $N_2$ and 75% of $H_2$, and the steel sheet was subsequently maintained at 1200° C. for 20 hr in an atmosphere gas consisting of 100% of $H_2$ to conduct a final finish annealing. In the final finish annealing, part of the sample was taken out of the annealing furnace for every 25° C. increase from 900° C. to 1200° C., cooled with water and subjected to observation of the structure and analysis of the N content. As a result, it was confirmed that the temperature of completion of the secondary recrystallization was 1050° C., the temperature at which the N content reached the maximum value was 975° C. and the N content of the steel sheet at that time was 0.0258 to 0.0270% by weight.

The process condition and the magnetic property of the product are given in Table 4.

TABLE 4

| Take-up condition after hot rolling | $B_8$ (T) | Remarks |
|---|---|---|
| 1 | 1.83 | Comp. Ex. |
| 2 | 1.90 | Present invention |

As described above, in the present invention, it is possible to produce a grain oriented electrical steel sheet having a good magnetic property through heating of a slab at a low temperature without annealing of a hot rolled sheet in a single cold rolling by regulating the take-up temperature after hot rolling and conducting nitriding at any stage from after the hot rolling to the completion of the second recrystallization in the final finish annealing.

We claim:

1. A process for producing a grain oriented electrical steel strip having excellent magnetic flux density, characterized by heating a slab consisting essentially of by weight 0.021 to 0.075% of C, 2.5 to 4.5% of Si, 0.010 to 0.060% of acid sol. Al, 0.0030 to 0.0130% of N, 0.014% or less of (S and 0.405 Se) and 0.05 to 0.8% of Mn with the balance being Fe and unavoidable impurities, to a temperature below 1280° C., hot rolling the slab to provide a hot rolled strip, cooling the hot rolled strip, taking up the resultant cooled strip in coil form at a temperature of 600° C. or below, then immediately cooling at a cooling rate of less than 0.01° C./sec down to an ambient temperature to prevent coarsening $Fe_3C$ and $Fe_{16}N_4$ precipitates in the strip, subjecting the hot rolled strip after said taking up to cold rolling with a reduction rate of 80% or more without annealing either prior to or during said cold rolling to provide a cold rolled strip, and subjecting the cold rolled strip to decarburization and then finish annealing to provide for secondary recrystallization, and steel strip being subjected to nitriding after completion of the hot rolling and prior to the completion of the secondary recyrstallization.

2. A process according to claim 1, wherein said nitriding increases the N content of the steel strip by 0.0001% by weight or more and total N content of the nitrided steel strip is not more than 0.027% by weight.

* * * * *